US008572903B2

(12) United States Patent
Krabill

(10) Patent No.: US 8,572,903 B2
(45) Date of Patent: Nov. 5, 2013

(54) DEVICE, KIT AND METHOD FOR SEALING ROOF PENETRATIONS

(75) Inventor: Don Krabill, Elkhart, IN (US)

(73) Assignee: The Sherwin-Williams Company, Cleveland, OH (US)

( * ) Notice: Subject to any disclaimer, the term of this patent is extended or adjusted under 35 U.S.C. 154(b) by 191 days.

(21) Appl. No.: 13/014,481

(22) Filed: Jan. 26, 2011

(65) Prior Publication Data

US 2011/0179738 A1 Jul. 28, 2011

Related U.S. Application Data

(60) Provisional application No. 61/299,262, filed on Jan. 28, 2010, provisional application No. 61/368,128, filed on Jul. 27, 2010.

(51) Int. Cl.

| | |
|---|---|
| ***E04D 1/36*** | (2006.01) |
| ***E04D 3/38*** | (2006.01) |
| ***E04B 1/00*** | (2006.01) |
| ***E04B 5/48*** | (2006.01) |
| ***E04D 13/00*** | (2006.01) |

(52) U.S. Cl.

USPC ..... 52/58; 52/98; 52/741.4; 285/42

(58) Field of Classification Search

USPC ..... 52/58, 60, 61, 97, 98, 287.1, 288.1, 52/219, 514, 514.5, 741.4, 742.13; 285/42

See application file for complete search history.

(56) References Cited

U.S. PATENT DOCUMENTS 515,153 A 2/1894 Miller
1,315,260 A * 9/1919 Tischler ..... 52/287.1

(Continued)

FOREIGN PATENT DOCUMENTS

CA 615327 2/1961
CA 640736 5/1962

(Continued)

OTHER PUBLICATIONS

"Applications in Sealants"; Silmond.TM. Silicon-Modified Polyethers; Union Chemicals and Plastic Company, Inc., Specialty Chemicals Division, Danbury, CT, 6 pages (1991).

(Continued)

*Primary Examiner* — Ryan Kwiecinski
(74) *Attorney, Agent, or Firm* — Barnes & Thornburg LLP

(57) ABSTRACT

A strip for use in sealing one or more roof penetrations comprising a strip including a plurality of panels positioned in a side-by-side manner, a plurality of flanges positioned in a side-by-side manner, a plurality of first hinges interconnecting the panels, and a plurality of second hinges interconnecting the panels with the flanges. The flanges being bendable relative to the panels. At least a portion of the strip configured to be disposed about the roof penetration to form a container for receiving sealant with the panels of said at least a portion of the strip extending generally perpendicular to the roof and the flanges of said at least a portion of the strip being bent relative to the panels to extend generally parallel to the roof. The remaining portion of the strip may be used to seal one or more other roof penetrations in a similar manner. A kit for sealing one or more roof penetrations including the strip, a container of adhesive and a container of sealant. A method for sealing one or more roof penetrations using the strip.

19 Claims, 4 Drawing Sheets

(56) References Cited

U.S. PATENT DOCUMENTS

| | | | | | |
|---|---|---|---|---|---|
| 1,406,469 | A | | 2/1922 | McGraw | |
| 1,494,234 | A | | 5/1924 | Gossett | |
| 2,054,308 | A | | 9/1936 | Tucker | |
| 2,985,465 | A | | 5/1961 | Church | |
| 3,247,636 | A | | 4/1966 | Mick et al. | |
| 3,677,576 | A | | 7/1972 | Gustafson | |
| 3,708,185 | A | | 1/1973 | Bilicki et al. | |
| 3,838,544 | A | * | 10/1974 | Hindall | 52/60 |
| 3,871,145 | A | | 3/1975 | Hatmaker | |
| 3,945,163 | A | | 3/1976 | Nagler et al. | |
| 4,010,578 | A | | 3/1977 | Logsdon | |
| 4,120,129 | A | | 10/1978 | Nagler et al. | |
| 4,248,926 | A | | 2/1981 | Tajima et al. | |
| 4,339,405 | A | | 7/1982 | Paszner | |
| 4,413,086 | A | | 11/1983 | Chang et al. | |
| 4,461,875 | A | | 7/1984 | Crepeau | |
| 4,544,593 | A | | 10/1985 | Borgert et al. | |
| 4,635,409 | A | * | 1/1987 | Vandemore | 52/60 |
| 4,664,390 | A | | 5/1987 | Houseman | |
| 4,707,961 | A | | 11/1987 | Nunley et al. | |
| 4,722,961 | A | | 2/1988 | Topcik | |
| 4,730,421 | A | | 3/1988 | Leeland | |
| 4,783,942 | A | | 11/1988 | Nunley et al. | |
| 4,799,986 | A | * | 1/1989 | Janni | 156/196 |
| 4,848,051 | A | | 7/1989 | Walls et al. | |
| 4,893,608 | A | | 1/1990 | Reaser | |
| 4,902,575 | A | | 2/1990 | Yukimoto et al. | |
| 4,928,443 | A | * | 5/1990 | Goodman et al. | 52/58 |
| 4,934,117 | A | | 6/1990 | Barksdale | |
| 4,937,991 | A | | 7/1990 | Orth | |
| 4,951,431 | A | | 8/1990 | Sweers | |
| 5,063,270 | A | | 11/1991 | Yukimoto et al. | |
| 5,130,354 | A | | 7/1992 | Gelles | |
| 5,226,263 | A | | 7/1993 | Gerber et al. | |
| 5,355,649 | A | | 10/1994 | Berridge | |
| 5,493,827 | A | | 2/1996 | Georgeau et al. | |
| 5,524,397 | A | | 6/1996 | Byers et al. | |
| 5,605,019 | A | * | 2/1997 | Maziekien et al. | 52/58 |
| 5,687,514 | A | | 11/1997 | Gillispie | |
| 5,749,182 | A | * | 5/1998 | Vavrinak | 52/169.14 |
| 5,768,838 | A | * | 6/1998 | Georgeau | 52/219 |
| 5,855,972 | A | | 1/1999 | Kaeding | |
| 5,899,034 | A | | 5/1999 | Janicki et al. | |
| 6,006,482 | A | | 12/1999 | Kelly | |
| 6,077,896 | A | | 6/2000 | Yano et al. | |
| 6,124,387 | A | | 9/2000 | Wang et al. | |
| 6,207,782 | B1 | | 3/2001 | Czech et al. | |
| 6,265,517 | B1 | | 7/2001 | Stuart | |
| 6,884,852 | B1 | | 4/2005 | Klauck et al. | |
| 7,121,047 | B2 | * | 10/2006 | Quinn | 52/60 |
| 7,347,907 | B1 | * | 3/2008 | Mayle et al. | 156/71 |
| 7,762,024 | B1 | * | 7/2010 | Resech | 52/60 |
| RE41,586 | E | | 8/2010 | Georgeau et al. | |
| 2003/0014926 | A1 | * | 1/2003 | Champa et al. | 52/60 |
| 2005/0028438 | A1 | * | 2/2005 | Campana | 47/33 |
| 2006/0053713 | A1 | * | 3/2006 | Remin | 52/287.1 |
| 2011/0232225 | A1 | * | 9/2011 | Margarites | 52/741.4 |
| 2012/0216474 | A1 | * | 8/2012 | Railkar | 52/302.6 |

FOREIGN PATENT DOCUMENTS

| | | |
|---|---|---|
| CA | 957477 | 11/1974 |
| DE | 1901745 | 8/1970 |
| DE | 3441743 | 5/1986 |
| DE | 3628958 | 3/1988 |
| DE | 3636032 | 4/1988 |
| DE | 4434207 | 3/1996 |
| DE | 19734346 | 5/1998 |
| DE | 29804406 U1 | 8/1998 |
| DE | 19800115 | 7/1999 |
| DE | 19959591 | 6/2000 |
| EP | 0874001 | 10/1998 |
| EP | 0949277 | 10/1999 |
| EP | 1088948 | 4/2001 |
| JP | 63-108058 | 5/1988 |
| JP | 63-114745 | 5/1988 |
| JP | 1115626 | 5/1989 |
| JP | 5293931 | 11/1993 |
| JP | 5329982 | 12/1993 |
| JP | 61-82295 | 5/1994 |
| JP | 9078029 | 3/1997 |
| JP | 2001-172513 | 6/2001 |
| WO | WO 9201742 | 2/1992 |
| WO | WO 9526998 | 10/1995 |
| WO | WO 9531620 | 11/1995 |
| WO | WO 9948942 | 9/1999 |
| WO | WO 0037534 | 6/2000 |
| WO | WO 0110914 | 2/2001 |

OTHER PUBLICATIONS

"Silyl-Terminated Polyethers for Sealants and Adhesives of a New Generation"; Kaneka MS Polymer.TM.; Kaneka Corporation, Tokyo Office, Tokyo, Japan, pp. 1-14 (1997).

* cited by examiner

DEVICE, KIT AND METHOD FOR SEALING ROOF PENETRATIONS

CROSS REFERENCE TO RELATED APPLICATIONS

This Application claims priority from U.S. Provisional Patent Application Ser. Nos. 61/299,262 filed Jan. 28, 2010, and 61/368,128 filed Jul. 27, 2010, the contents of which applications are herein incorporated by reference in their entireties.

The present disclosure relates to a kit and method for sealing roof penetrations.

BACKGROUND

Roofs typically are constructed to include a water impervious upper layer to prevent water from penetrating the roof structure. Although different materials are used depending on the type of roof constructed, this waterproof layer or surface is generally referred to as a roof membrane.

Roofs often have one or more penetrations extending upwardly and physically penetrating or extending through the waterproof layer of the roof. These penetrations may include vents, pipes, conduits or support members. Where these elements extend through the roof, they pierce the waterproof layer of the roof and define potential leak paths for water to penetrate therethrough. To prevent water from leaking or migrating through the waterproof layer at these points, special care must be taken to seal the hole created in the membrane by the penetrating element. Often, a pitch pan is disposed about the penetration and sealant is deposited within the pitch pan to achieve sealing.

SUMMARY

The present disclosure is directed to a device for use in sealing one or more roof penetrations. The device comprises a strip including a plurality of panels positioned in a side-by-side manner, a plurality of flanges positioned in a side-by-side manner, a plurality of first hinges, each first hinge interconnecting a respective pair of panels, and a plurality of second hinges interconnecting the panels and the flanges. The flanges are pivotable or otherwise bendable relative to the panels. At least a portion of the strip is configured to be disposed about the roof penetration to form a container for receiving sealant with the panels of said at least a portion of the strip extending generally perpendicular to the roof and the flanges of said at least a portion of the strip being bent relative to the panels to extend generally parallel to the roof. Each panel is readily separable from an adjacent panel for separating the portion of the strip forming the container from the remaining portion of the strip. A remaining portion of the strip may be used in a similar manner to seal one or more other roof penetrations.

The device may be part of a kit for sealing one or more roof penetrations. The kit may also include a container of adhesive for adhering the flanges to the roof and a container of sealant for depositing sealant into the container. Once a first roof penetration is sealed, the kit may be used to seal one or more additional roof penetrations.

The present disclosure is also directed to a method for use in sealing one or more roof penetrations. The method includes separating a pair of adjacent panels of a strip including a plurality of panels positioned in a side-by-side manner and interconnected by a plurality of first hinges and a plurality of flanges joined to the bases of the panels by a plurality of second hinges and positioned in a side-by-side manner to form a first portion of the strip for use in forming a container for disposing about the roof penetration. The method also includes surrounding the first roof penetration with the first portion of the strip to form a wall of the first container; and bending the flanges of the first portion of the strip along the second hinges relative to the panels of the first portion of the strip to form a bottom of the container. The method also may include adhering the flanges to the roof with an adhesive. The method also may include depositing sealant into the container. The remaining portion of the strip may be used in a similar manner to seal one or more other roof penetrations.

Features and advantages of the disclosure will be set forth in part in the description which follows and the accompanying drawings described below, wherein one or more embodiments of the disclosure is described and shown, and in part will become apparent upon examination of the following detailed description taken in conjunction with the accompanying drawings.

BRIEF DESCRIPTION OF THE DRAWINGS

The present invention and the advantages thereof will become more apparent upon consideration of the following detailed description when taken in conjunction with the accompanying drawings.

DETAILED DESCRIPTION

Figure 1:
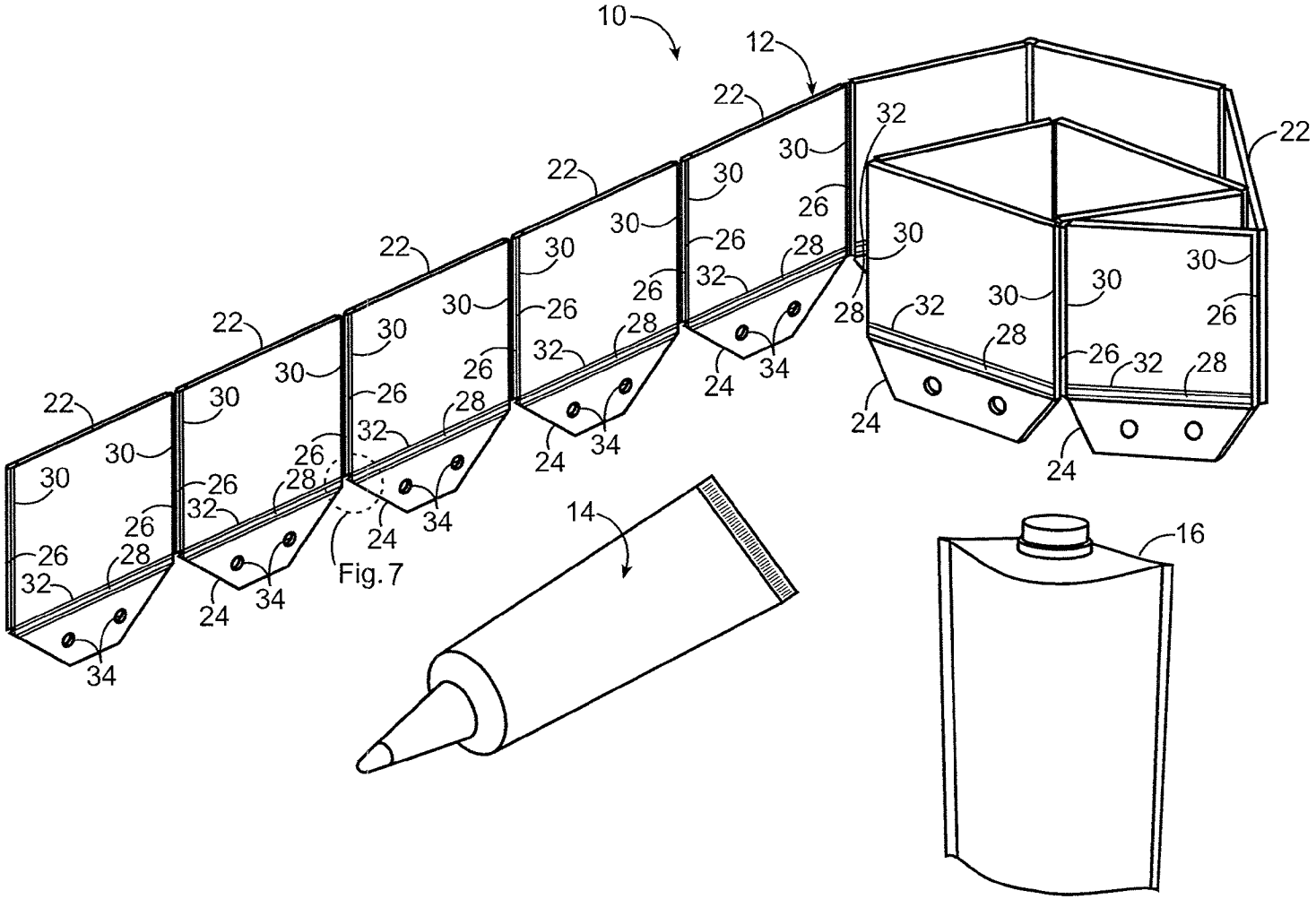
FIG. 1 is a perspective view of a kit for sealing one or more roof penetrations in accordance with an illustrated embodiment of the present disclosure.

While the present disclosure may be susceptible to embodiment in different forms, there is shown in the drawings, and will be described herein in detail, one or more embodiments with the understanding that the present description is to be considered an exemplification of the principles of the disclosure and is not intended to be exhaustive or to limit the disclosure to the details of construction and the arrangements of components set forth in the following description or illustrated in the drawings.

FIGS. 1-9 illustrate a kit 10 for sealing a roof penetration comprising a strip 12, a container of adhesive 14, and a container of sealant 16. The strip 12 comprises a plurality of panels 22 interconnected in a side-by-side manner, a plurality of flanges 24 positioned in a side-by-side manner, a plurality of first hinges 26 interconnecting the panels, and a plurality of second hinges 28 interconnecting the panels with the flanges. Each panel 22 is joined to a respective flange 24 by a respective second hinges 28, and the respective flange 24 is pivotable relative to the panel. The strip 12 may be constructed of any suitable PVC or other plastic, rubber or any other suitable material. The strip 12 may initially be of any suitable length. A portion or the entirety of the strip 12 may initially be rolled up as illustrated in FIG. 1 or may be initially have any other suitable configuration.

The illustrated panels 22 are generally rectangular and the illustrated flanges 24 are generally trapezoidal. Each of the panels 22 includes a pair of lateral edges 30 and a base edge 32. Each of the flanges 24 defines a pair of holes 34 receiving screws, nails or the like for securing the strip 12 to the roof. The panels 22 and flanges 24 may be in the form of any suitable segment or section and may have any other shape or configuration in accordance with other embodiments of the present disclosure. The strip 12 may be secured to the roof in any other suitable manner in accordance with other embodiments of the present disclosure.

Each of the illustrated first hinges 26 is disposed between adjacent panels 22 and interconnects the lateral edges 30 of the adjacent panels. Each of the first hinges 26 defines a U-shaped channel 36 extending substantially along the length of the adjacent panels 22 parallel to the lateral edges 30, and includes a first hinge base 38 and a pair of first hinge portions 40 disposed about the first hinge base and interconnecting the first hinge base 38 with lateral edges 30 of the adjacent panels 22. The first hinge base 38 and the first hinge portions 40 extend substantially the entirely length of the lateral edges 30 parallel to the lateral edges. Each hinge portion 40 has a curved radius or otherwise extends arcuately from the first hinge base 38 to the respective lateral edge 30. The first hinge bases 38 comprise lines of reduced thickness along the strip 12 to facilitate hinging action in either direction and to facilitate placement of the strip 12 around a roof penetration. The line of reduced thickness also facilitates ready separation of adjacent panels 22. The first hinges 26 may have any other construction or configurations in accordance with other embodiments of the present disclosure.

Each of the illustrated second hinges 28 defines a pair of oppositely-facing U-shaped channels 50 between the base edge 32 of the respective panel and the respective flange 24. Each second hinge 28 includes a second hinge base 52 and a pair of second hinge portions 54, and a pair of second hinge portions 56 disposed about the second hinge base. Second hinge portions 54 interconnect the second hinge base 52 with the base edge 32 of one of the panels 22, and second hinge portions 56 interconnect the second hinge base 52 with a flange edge 64 of one of the flanges 24. The second hinge base 52 and the second hinge portions 54 and 54 extend substantially the entire length of the base edge 32 of the panel 22 and the flange edge 64 of the flange 24 and substantially parallel to base edge 32 and flange edge 64. Each second hinge portion 54 and 56 has a curved radius or otherwise extends arcuately from the second hinge base 52 toward the base edge 32 or flange edge 64. Thus, each of the second hinge bases 52 comprises a line of reduced thickness to facilitate pivoting of the flanges 24 relative to the panels 22. In the illustrated embodiment, the flanges 24 can pivot in either direction. The second hinges 28 may have any other construction or configurations in accordance with other embodiments of the present disclosure.

The first hinges 26 extend generally perpendicular to the second hinges 28. Each second hinge 28 extends the entire length of the flange edge 64 of the panels 22 but terminates on each end at the lateral edge 30 of the panel such that the first and second hinges do not intersect. The first hinge 26 includes a front face 80 extending substantially perpendicular to the first hinge base 38. The front face 80 has a pair of curved portions 82. Each curved portion 82 extends arcuately from the first hinge base 38 toward a respective adjacent second hinge 28. The second hinge 28 also includes a front face 84 extending substantially perpendicular to the second hinge base 52. The front face 84 has a curved radius or otherwise extends arcuately towards the flange 24. The structures and locations of the first and second hinges 26 and 28 minimize or eliminate interference between these hinges.

The adhesive may be in the form of any suitable glue or other suitable adhesive, and the container of adhesive 14 may have any configuration and construction and may operate in any suitable manner. The sealant may be in the form of any suitable sealant used in connection with sealing roof penetrations or roofs or may be in any other suitable form. The container of sealant 16 may have any configuration and construction and may operate in any suitable manner. The containers 14 and 16 may be sized to be hand held.

In operation, a first portion of the strip 12 sufficient in length to form a container around the roof penetration is extended from the sleeve roll. The first portion of the strip 12 is then separated from the remaining portion of the strip 12 by separating a pair of adjacent panels 22 of the strip along one of the first hinges 26 at a suitable location to achieve a suitable length. The separation can be achieved, for example, with a cutting knife or in any other suitable manner. The flanges 24 of the first portion of the strip 12 are then bent approximately 90 degrees, all in the same direction. The first portion of the strip 12 is then extended around the perimeter of the roof penetration to form the container, with the panels 22 forming a container wall 90 around the roof penetration and the flanges 24 forming a container bottom 92. The container wall 90 extends generally perpendicular to the roof and the flanges 24 engage and extend generally parallel to the roof.

The first portion of the strip 12 may be secured in an enclosed position around the perimeter in any suitable manner. For example, one or more of the panels 22 of one end of the strip 12 may be overlapped around the outside or inside of one or more panels of the other end of the strip and then secured to the one or more panels of the other end by a self-tapping screw or in any other suitable manner. Adhesive A may be applied to the bottom of the flanges 24 before or during the formation of the container to secure the flanges 24 to the roof. The flanges 24 may be further secured to the roof by screws, nails, staples or the like. The adhesive may be omitted in accordance with other embodiments of the present disclosure.

Additionally, the adhesive may be disposed around the perimeter of the roof penetration before securing the first portion of the strip 12 to the roof to provide additional sealing benefits. The adhesive may also be disposed about the perimeter of the base of container wall 90 after it is formed also to provide additional sealing benefits.

The opposed ends of the first portion of the strip 12 may be secured in any other suitable manner in accordance with other embodiments of the present disclosure. For example, a clip, Velcro or the like can be used to secure the first portion of the strip 12 in the enclosed position in accordance with other embodiments of the present disclosure. Any suitable sealant S may be deposited within the container. The remaining portion of the strip 12 may be used in a similar manner to seal one or more other roof penetrations.

Figure 2:
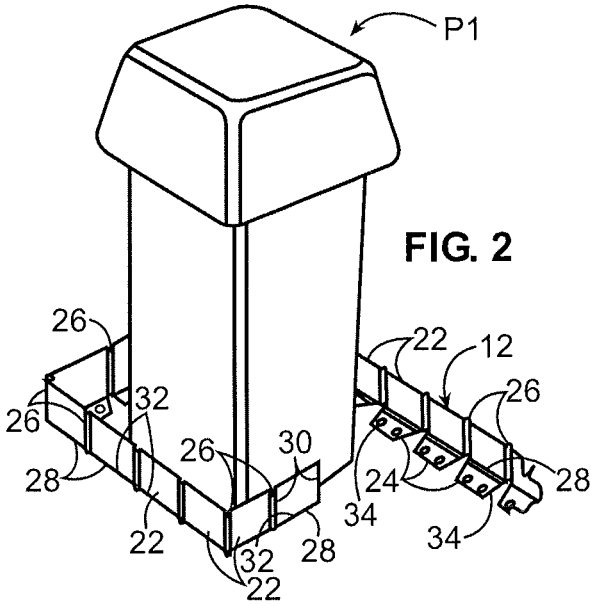
FIG. 2 is a perspective view of a portion of the strip of the kit of FIG. 1 being used to form a container about a roof penetration.
Figure 3:
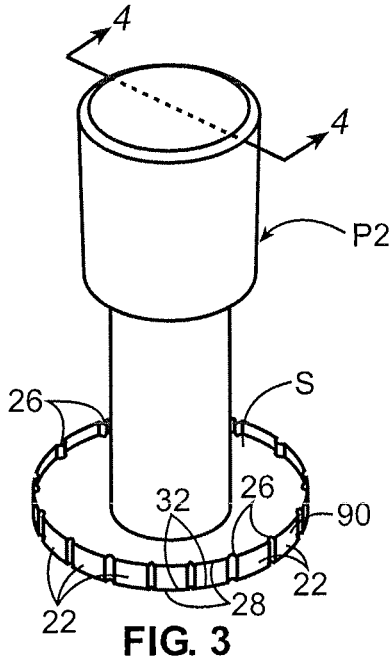
FIG. 3 is a perspective view of the kit of FIG. 1 used to form a container about an other roof penetration and sealant deposited within the container for sealing the other roof penetration.
Figure 4:
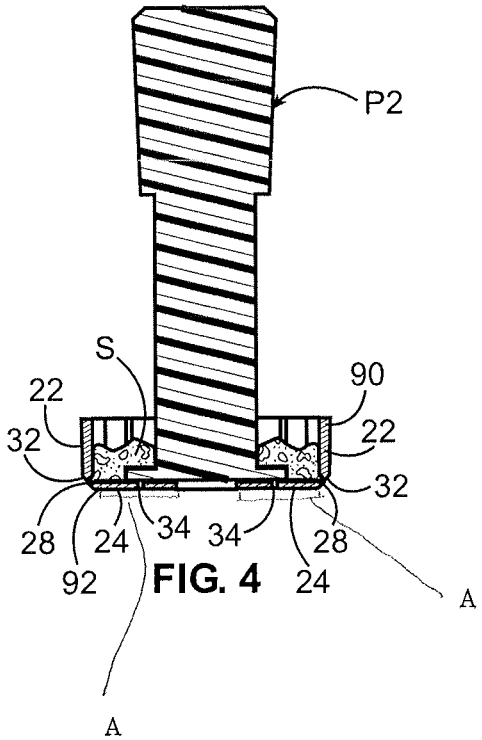
FIG. 4 is a cross section view taken along the lines 4-4 of FIG. 3.
Figure 5:
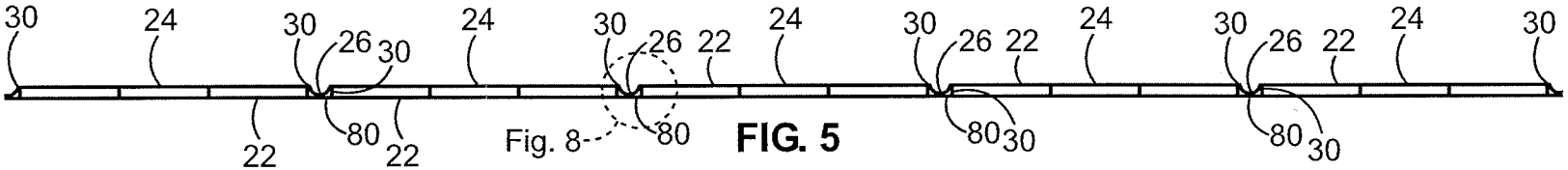
FIG. 5 is a plan view of a portion of the strip of the kit of FIG. 1 taken from the flange end portion of the strip.
Figure 6:
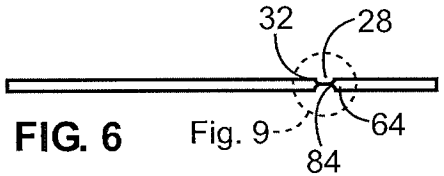
FIG. 6 is a side view of the portion of the strip of FIG. 5.
Figure 8:
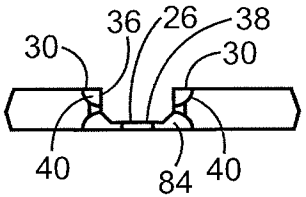
FIG. 8 is an enlarged view of Detail 8-8 of FIG. 5.
Figure 9:
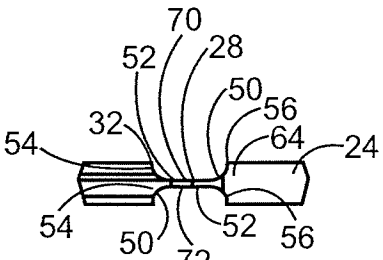
FIG. 9 is an enlarged view of Detail 9-9 of FIG. 6.
Figure 7:
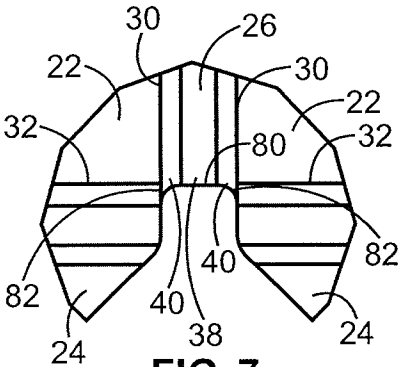
FIG. 7 is an enlarged view of Detail 7-7 of FIG. 1.
Figure 10:
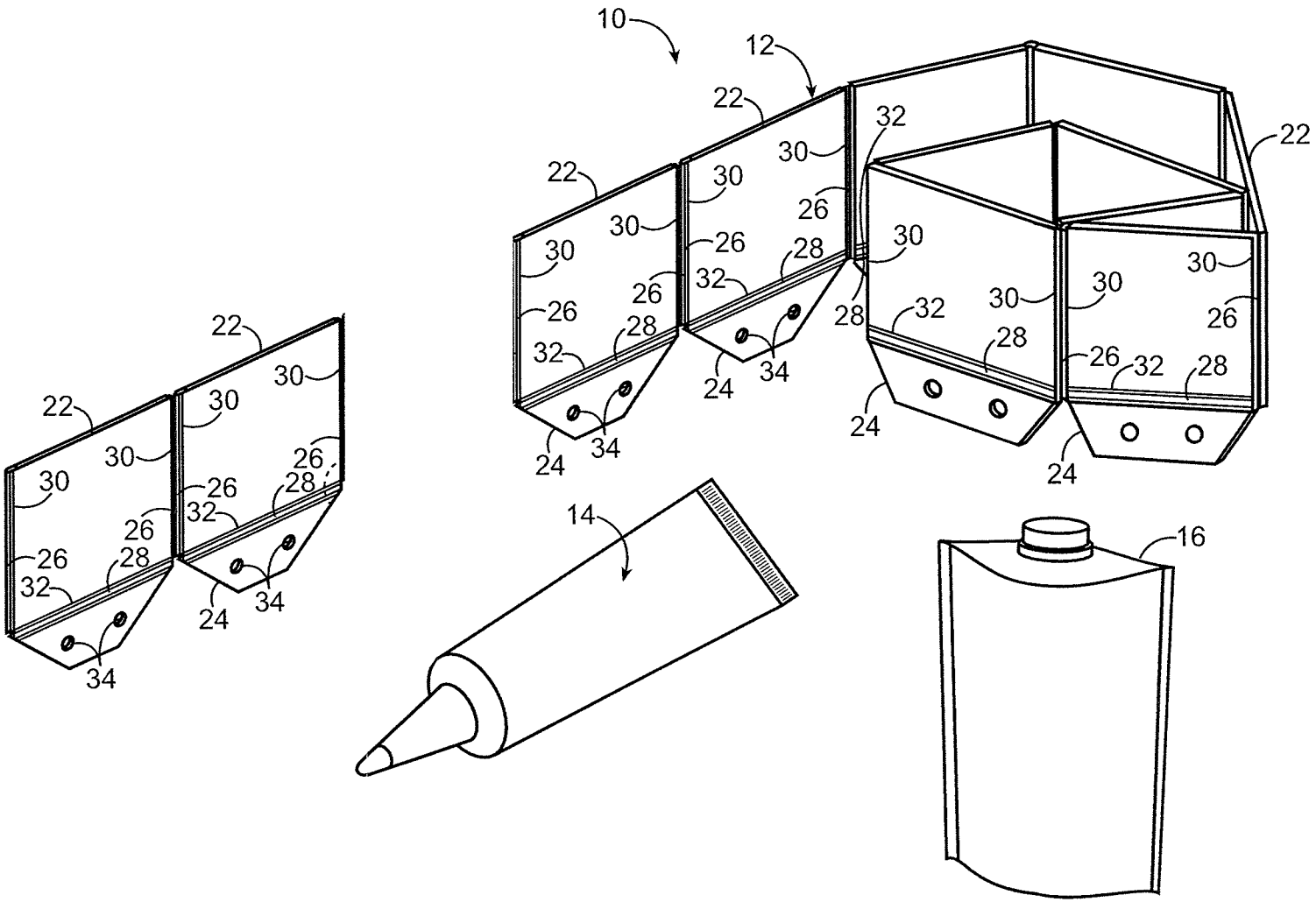
FIG. 10 is identical to FIG. 1 except that it illustrates adjacent panels of the strip separated for securing a portion of the strip around the roof penetration.

FIG. 2 illustrates the first portion of the strip 12 being disposed about a roof penetration P1 having a base with rectangular cross section and being used to form a rectangular pitch pan. FIG. 3 illustrates the first portion of the strip 12 disposed about a roof penetration P2 having a base with a circular cross section and forming a circular pitch pan. The first portion of the strip 12 may be used to form a pitch pan having any other configuration and may be disposed about a roof penetration having any suitable configuration. Further, the roof may extend substantially horizontally or may extend on an incline.

One of the advantages of the illustrated embodiment of the present disclosure is that the pitch pan type container can be readily formed from the strip 12 and also can be readily secured about a roof penetration, regardless of the configuration of the roof penetration. Further, the strip 12 can be used to readily construct additional pitch pan type containers.

While embodiments have been illustrated and described in the drawings and foregoing description, such illustrations and descriptions are considered exemplary and not restrictive in character, it being understood that only illustrative embodiments have been shown and described and that all changes and modifications that come within the spirit of the invention are desired to be protected. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

What I claim:

1. A kit for use in sealing one or more roof penetrations comprising a strip including a plurality of panels positioned in a side-by-side manner, the panels being substantially similar in size to each other, a plurality of flanges positioned in a side-by-side manner, the flanges being substantially similar in size to each other, a plurality of first hinges, each first hinge interconnecting one of the panels with an adjacent one of the panels and facilitating pivoting of said one of the panels relative to said adjacent one of the panels in either direction, and a plurality of second hinges, each second hinge interconnecting one of the flanges to a respective one of the panels and facilitating pivoting of said one of the flanges relative to said respective one of the panels in either direction, each one of the flanges being bendable relative to said respective one of the panels, at least a portion of the strip configured to be disposed about one roof penetration to form a container for receiving sealant with the panels of said at least a portion of the strip extending generally perpendicular to the roof and the flanges of said at least a portion of the strip being bent inwardly relative to the panels toward a center of the container to extend generally parallel to the roof.

2. The kit of claim 1 further comprising a container of adhesive for securing the flanges of said at least a portion of the strip to the roof and a container of sealant for depositing sealant into the container.

3. The kit of claim 1 wherein each panel is readily separable from said respective adjacent panel for separating said at least a portion of the strip forming the container from a remaining portion of the strip.

4. The kit of claim 1 wherein each first hinge defines a U-shape channel substantially along a length of respective adjacent panels.

5. The kit of claim 1 wherein each first hinge comprises a line of reduced thickness.

6. The kit of claim 5 wherein each panel includes a pair of lateral edges, each first hinge further comprising a pair of first hinge portions disposed about a respective line of reduced thickness, each first hinge portion interconnecting a respective lateral edge of respective adjacent panels with the respective line of reduced thickness substantially along a length of the respective lateral edge and extending arcuately from the respective line of reduced thickness to the respective lateral edge.

7. The kit of claim 6 wherein the first and second hinges extend substantially perpendicular to each other and wherein each of the first hinge portions includes an end having a front face, each front face including a pair of curved surfaces disposed about the respective line of reduced thickness extending from the respective line of reduced thickness towards a respective second hinge of the respective adjacent panels.

8. The kit of claim 1 wherein each panel includes a pair of lateral edges and a base edge extending substantially perpendicular to the lateral edges, and wherein each second hinge defines a pair of oppositely facing U-shaped channels extending substantially along a length of the base edge of the panel.

9. The kit of claim 8 wherein each second hinge further comprises a line of reduced thickness extending substantially along the length of the base edge of the panel and a pair of top curved surfaces extending substantially along the length of the base edge of the panel and disposed about a respective line of reduced thickness, one of the top curved surfaces interconnecting the base edge of the panel with the respective line of reduced thickness substantially along the length of the base edge, the other top curved surface interconnecting a rear edge of a respective flange with the respective line of reduced thickness substantially along the length of the rear edge.

10. The kit of claim 9 wherein each second hinge further comprises a pair of bottom curved surfaces extending substantially along the length of the base edge of the panel and disposed about the respective line of reduced thickness, one of the bottom curved surfaces interconnecting the base edge of the panel with the respective line of reduced thickness substantially along the length of the base edge, the other bottom curved surface interconnecting the rear edge of the respective flange with the respective line of reduced thickness substantially along the length of the rear edge.

11. The kit of claim 1 wherein the first and second hinges extend perpendicular to each other.

12. The kit of claim 11 wherein each panel includes a pair of lateral edges, each lateral edge disposed adjacent a respective first hinge, and wherein each second hinge extends from a respective lateral edge of said one of the panels to a respective lateral edge of said adjacent one of the panels.

13. The kit of claim 12 wherein each second hinge begins at said respective lateral edge of said one of the panels and terminates at said respective lateral edge of said adjacent one of the panels.

14. The kit of claim 11 wherein each second hinge has a pair of opposed end faces, each end face including a portion extending arcuately towards a respective flange.

15. The kit of claim 1 wherein each flange is generally trapezoidal.

16. The kit of claim 15 wherein each respective flange has a base edge interconnected with a base of said respective one of the panels and a top edge, the top edge shorter in length than the base edge.

17. A method for sealing one or more roof penetrations, including separating a pair of adjacent panels of a strip including a plurality of panels positioned in a side-by-side manner, the panels being substantially similar in size and interconnected by a plurality of first hinges and a plurality of flanges joined to the panels by a plurality of second hinges the flanges being substantially similar in size and positioned in a side-by-side manner to form a first portion of the strip for use in forming a container around the roof penetration, each first hinge interconnecting one of the panels with an adjacent one of the panel and facilitating pivoting of said one of the panels relative to said adjacent one of the panels in either direction and each second hinge interconnecting one of the flanges to a respective one of the panels and facilitating pivoting of said one of the flanges relative to said respective one of the panels in either direction;

surrounding the roof penetration with the first portion of the strip to form a wall of the container;

bending the flanges of the first portion of the strip along the second hinges inwardly relative to the panels of the first portion of the strip toward a center of the container to form a bottom of the container; and depositing sealant into the container.

18. The method of claim 17 further including applying adhesive to the flanges to secure the flanges to the roof.

19. A method for sealing a plurality of roof penetrations, including separating a pair of adjacent panels of a strip including a plurality of panels positioned in a side-by-side manner, the panels being substantially similar in size and interconnected by a plurality of first hinges, and a plurality of flanges joined to the bases of the panels by a plurality of second hinges, the flanges being substantially similar in size and positioned in a side-by-side manner to form a first portion of the strip for use in forming a first container for disposing about a first roof penetration, each first hinge interconnecting one of the panels with an adjacent one of the panels and facilitating pivoting of said one of the panels relative to said adjacent one of the panels in either direction, and each second hinge interconnecting one of the flanges to a respective one of the panels and facilitating pivoting of said one of the flanges relative to said respective one of the panels in either direction;

surrounding the first roof penetration with the first portion of the strip to form a wall of the first container; and bending the flanges of the first portion of the strip along the second hinges relative to the panels of the first portion of the strip to form a bottom of the first container;

depositing sealant into the first container;

separating a pair of adjacent panels of a remaining portion of the strip to form a second portion of the strip for use in forming a second container for disposing about a second roof penetration;

surrounding the second roof penetration with the second portion of the strip to form a wall of the second container;

bending the flanges of the second portion of the strip inwardly relative to the panels of the second portion of the strip toward a center of the container to form a bottom of the second container; and depositing sealant into the second container.

* * * * *